United States Patent [19]

Burke

[11] 4,021,859

[45] May 10, 1977

[54] DISPOSABLE HATS

[75] Inventor: Francis V. Burke, Blackwood, N.J.

[73] Assignee: Work Wear Corporation, Cleveland, Ohio

[22] Filed: Sept. 12, 1975

[21] Appl. No.: 612,903

[52] U.S. Cl. ..... 2/197

[51] Int. Cl.[2] ..... A42B 1/22

[58] Field of Search ..... 2/197, 195, 183, 181

[56] References Cited

UNITED STATES PATENTS

| | | | |
|---|---|---|---|
| 2,343,408 | 3/1944 | Glass | 2/181 X |
| 3,027,564 | 4/1962 | Wagenfeld | 2/197 X |
| 3,383,709 | 4/1968 | Bauer | 2/197 |
| 3,550,160 | 12/1970 | Gruber | 2/197 |
| 3,728,740 | 4/1973 | Wagenfeld | 2/197 |

*Primary Examiner*—Werner H. Schroeder
*Assistant Examiner*—Peter Nerbun
*Attorney, Agent, or Firm*—John W. Logan, Jr.

[57] ABSTRACT

The preferred embodiment of the invention disclosed herein comprises a headband formed from a generally rectangular sheet of paper folded intermediate its shorter ends such that the end portions are in overlapping relationship. Extending from one elongated edge of the headband is a crown member and extending along the other elongated edge is a sweatband, preferably, in the form of a moisture resistant wax or plastic material. Each of the end portions of the headband includes an elongated strip of adhesive of the type that adheres only to itself so that the relative position of the end portions can be adjusted to accommodate different head sizes. Preferably, the adhesive on one end portion is a transversely extending strip on the outer surface of the headband and the adhesive on the other end portion is a longitudinally extending strip on the inner surface of the headband whereby adhesive contact through a range of sizes can be assured.

5 Claims, 4 Drawing Figures

FIG. 1.
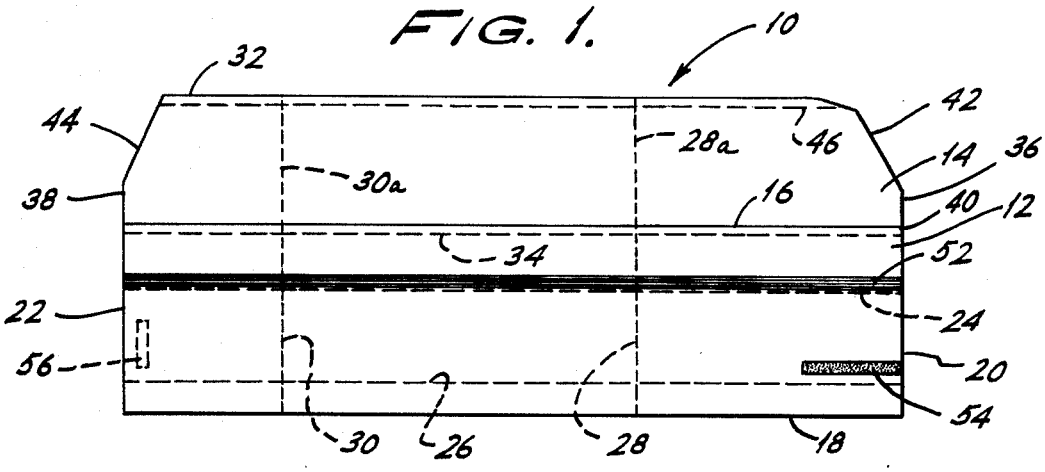
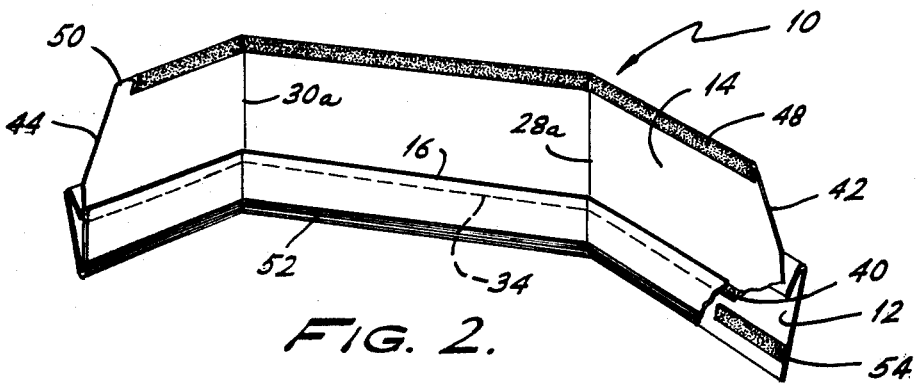
FIG. 2.
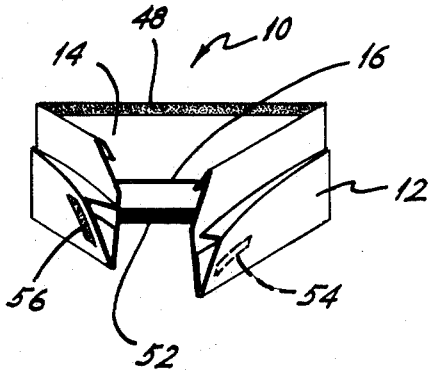
FIG. 3.
FIG. 4.
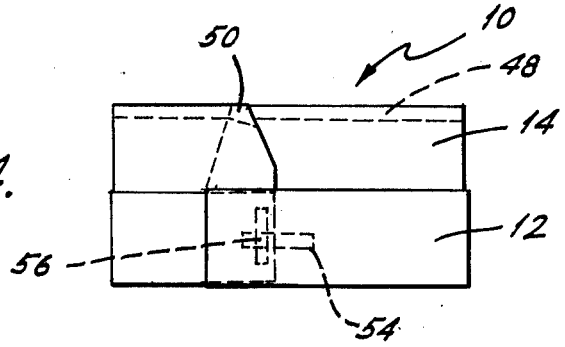

DISPOSABLE HATS

The invention disclosed in this application relates to disposable hats and, more particularly, to disposable hats adjustable for different head sizes and which can be easily and economically manufactured.

In various industries and in food related industries in particular, it is usual and necessary for workers to wear hats to prevent hair from falling into food or other materials. As a generalization, these hats have a short useful life because they become discolored due to perspiration and for other reasons or because the workers lose or forget the hats necessitating the use of a new one. Accordingly, these hats should be relatively low-cost and readily disposable.

One type of hat presently utilized includes a paper headband formed from a rectangular sheet folded intermediate its shorter edges such that overlapping end portions are provided. One elongated edge of the headband is secured to a crown portion and the other elongated edge has a sweatband extending therearound. The sweatband is made of paper or other moisture-absorbing material and it is adhesively secured to the inside of the headband. Adjustability is provided by a strip of pressure-sensitive adhesive on one of the overlapping end portions so that the end portions can be secured at different relative positions providing different sizes. Normally, a strip of paper is placed over the adhesive to prevent engagement of the adhesive with the other end portion of the headband until it is ready for use at which time, the paper is removed.

Hats of the type described above are relatively expensive because of the cost of the adhesive and paper utilized for the sweatband and because of the additional manufacturing steps required to apply both the adhesive and the paper. In addition, the cost of these types of hats is increased because of the cost of the paper strip and the step of placing the paper strip on the pressure-sensitive adhesive used to secure the hats in the adjusted position.

Accordingly, it is a primary object of this invention to provide a disposable, easily adjustable hat that does not require either a paper sweat band or a protective paper strip on the adhesive.

It is another object of this invention to provide a disposable, easily adjustable hat that is of relatively low-cost and which is not easily discolored by perspiration.

These and other objects of this invention are accomplished by providing a hat having a head band formed from a generally rectangular sheet of paper or similar low cost material and folded along lines intermediate its shorter edges so that the adjacent end portions are in overlapping relationship. A crown portion may be secured to extend from one elongated edge of the headband and a sweatband, preferably in the form of a suitable plastic or wax extends along the other elongated edge. Each of the end portions is coated with an adhesive that adheres only to itself so that the headband can be adjusted for different head sizes and secured into its adjusted position.

Preferably, the adhesive is of the latex type and extends transversely along the outer surface of one of the end portions and longitudinally along the inner surface of the other end portion. The sweatband is preferably a strip of wax or plastic both of which are moisture resistant.

For a better understanding of the invention, reference is made to the following description of a preferred embodiment taken in conjunction with the figures of the accompanying drawing in which:

FIG. 1 is a plan view of a composite blank used to form a hat in accordance with this invention;

FIG. 2 is a perspective view of the blank illustrated in FIG. 1 and folded along longitudinal fold lines;

FIG. 3 is a perspective view of the blank illustrated in FIG. 2 and folded along both longitudinal and transverse fold lines; and, FIG. 4 is a plan view of a hat constructed in accordance with this invention.

Referring to the drawings, there is illustrated a disposable hat 10 including a headband 12 and a crown 14, the former being made from a relatively stiff paper and the latter being made from a softer paper or open mesh type plastic or fiber. While the hat is illustrated as including a separate headband and crown, it should be understood that the hat may be of one-piece construction, but that the two-piece construction is preferred. The headband comprises a generally elongated rectangular sheet of paper having elongated longitudinal edges 16 and 18 and shorter transverse edges 20 and 22. Formed adjacent to, but spaced from the elongated edge 16 is a first longitudinal fold line 24 and formed adjacent, but spaced from the elongated edge 18, is a second longitudinal fold line 26. Formed intermediate the transverse edges 20 and 22, are a pair of transverse fold lines 28 and 30. The transverse fold line 28 is spaced from the transverse edge 20 a greater distance than the spacing between the transverse fold line 30 and the transverse edge 22 so that the headband may be folded along the transverse fold lines to provide the front and back edges of the hat. The spacing between the transverse fold lines 28 and 30 is such that the headband approximates the smallest head size to be accommodated.

The crown 14 is also formed from a generally rectangular sheet of material having longitudinal edges 32 and 34 and transverse edges 36 and 38. The portion adjacent longitudinal edge 34 is secured adjacent the longitudinal edge 16 of the headband by a suitable adhesive 40. The crown is further formed with generally transverse fold lines **28*a* and 30*a* which are continuations of the transverse fold lines 28 and 30 formed on the headband. When the hat is folded into assembled relationship, the fold lines 28*a* and 30*a* provided the front and rear edges of the crown 14. The transverse edges 36 and 38 of the crown 14 are provided with angular cuts 42 and 44 extending toward each other so that the longitudinal edge 32 is shorter than the longitudinal edge 34. Adjacent the longitudinal edge 32 is formed a longitudinally extending fold line 46 so that a portion of the crown may be folded in overlying relationship with the rest of the crown as shown in FIGS. 2 and 3 of the drawing. In addition, this portion of the crown, that is, the portion between the fold line 46 and longitudinal edge 32 is coated with an adhesive 48 so that the crown may be secured together when the hat is assembled. As best seen in FIG. 2 of the drawing, a small area 50** of the folded portion is preferably not coated with an adhesive for reasons to be made clear hereinafter.

Directly adjacent the fold line 24 is located a strip 52 of wax or plastic material, preferably of the type that is moisture-resistant. When the hat is assembled this strip will function as a sweatband. On the exposed face of the headband 12, as viewed in FIG. 1 of the drawing, there is provided an adhesive strip 54 extending generally parallel to and slightly spaced from the fold line 26 from a point adjacent the transverse edge 20 to a point located intermediate the transverse edge 20 and the transverse fold line 28. On the face of the headband that is not seen in FIG. 1 of the drawing, there is provided an adhesive strip 56 extending generally parallel to and slightly spaced from the transverse edge 22 from the longitudinal fold line 26 to a point intermediate the longitudinal fold lines 24 and 26. The adhesive strips are comprised of an adhesive of the type that adheres to itself only and under the influence of pressure. Usually this is a latex type adhesive and one example is the typed sold by United Resin Products of Brooklyn, New York under the designation 40–117.

As should be understood, the adhesives and wax can be applied to the blank while it is in the flattened condition illustrated in FIG. 1 of the drawing. Thereafter, the longitudinal fold lines 26, 24 and 46 may be folded to the position illustrated in FIG. 2 of the drawing. Thus, the headband is folded along the fold line 26 and the fold line 24 to provide an outer headband surface and an inner headband surface adapted to bear on the head of the user. The outer headband surface can of course be provided with advertising or other indicia as is usual. At this point, it is noted that one end portion of the headband, the portion adjacent transverse edge 22, so that it is slightly smaller from top to bottom than the end portion adjacent the other edge so that the smaller end portion can be telescoped into the larger end portion when the hat is assembled.

As seen in FIG. 3 of the drawing, the headband 12 and crown 14 are folded along the transverse fold lines **28, 30, 28*a* and 30*a* so that the end portions are in overlapping relationship providing inner and outer headband and crown end portions. As the crown is folded, the adhesive 50 secures the crown is closed relationship between the longitudinal edge 52 and the fold line 40. The area 50 is not coated with adhesive and does not secure the crown together where this area bears against the adjacent surface of the crown. With the arrangement of area 50**, the overlapping ends of the crown are not secured and adjustment of the hat is facilitated since no stresses are imposed.

When it is desired to use the hat, the smaller end portion of the headband 12 is telescopically inserted into the larger end portion and the end portions are slid away from each other until the headband assumes the desired size. Then, the adhesive strips are pressed together securing the headband in its adjusted size. By providing the elongated and transverse adhesive strips, the hat may be adjusted to any desired size and contact between the strips is always assured. By using adhesive that sticks only to itself a protective strip of paper need not be placed over the adhesive until the hat is to be used.

While in the foregoing there has been described a preferred embodiment of the invention, it should be understood that various modifications and changes will become obvious to those skilled in the art and are within the spirit and scope of the invention as recited in the appended claims.

I claim:

1. A disposable hat comprising a headband formed from a generally rectangular sheet of material folded along lines intermediate its shorter edges so that the end portions thereof are in overlapping relationship, said end portions being of a size and shape to be telescopically arranged with an inner surface of one end portion being adjacent to and in abutting relationship with an outer surface of the other end portion, each of said surfaces including a strip of adhesive of the type that adheres to itself only, the size of said headband being adjustable by adjusting the relative positions of the end portions and said end portions being secured in the adjusted position by the adhesive strips when said end portions are telescopically arranged, a crown extending from one longitudinal edge of said headband, said crown being formed from an elongated sheet of material folded along lines intermediate its shorter edges so that the end portions of said crown are in overlying relationship, a strip of adhesive extending adjacent the free longitudinal edge of said elongated sheet from one transverse edge toward the other transverse edge and terminating adjacent said other transverse edge whereby an area adjacent said other transverse edge is left without a strip of adhesive whereby the adjacent surfaces of said end portion are not adhesively secured.

2. A disposable hat in accordance with claim 1 wherein a strip of moisture resistant material extends around the inner surface of the headband adjacent lower longitudinal edge thereof to provide a sweatband, said moisture resistant material being a wax or plastic material.

3. A disposable hat in accordance with claim 1 wherein one adhesive strip extends longitudinally and the other adhesive strip extends transversely.

4. A disposable hat in accordance with claim 1 wherein said adhesive is of the latex type.

5. A disposable hat comprising a headband and a crown each formed from a generally rectangular sheet of material, said crown extending from one elongated edge of said headband, both said headband and said crown being folded so that each have end portions in overlapping relationship, the end portions of said headbank being of a size and shape to be telescopically arranged with an inner surface of one of said end portions being adjacent to and in abutting relationship with an outer surface of the other end portion, said inner surface including a generally longitudinal strip of adhesive and said outer surface including a generally transverse strip of adhesive, said strips of adhesive being comprised of adhesive of the type that adheres only to itself so that the headband can be adjusted and secured in an adjusted position, a strip of moisture-resistant material extending around said headband adjacent another elongated edge to provide a sweatband, said moisture-resistant material being a wax or plastic material, a portion of said crown being adhesively secured to itself, one end portion of said crown being an outer portion and the other end portion of said crown being an inner portion, adjacent surfaces of said inner and outer end portions not being secured to facilitate adjustment of said headband.

* * * * *